United States Patent [19]

Sheaffer et al.

[11] Patent Number: 4,953,823

[45] Date of Patent: Sep. 4, 1990

[54] COASTER AND WIPE

[76] Inventors: William G. Sheaffer; Robin L. Sheaffer, both of 4545 S. Mission Rd., lot 332, Tucson, Ariz. 85714

[21] Appl. No.: 385,308

[22] Filed: Jul. 25, 1989

[51] Int. Cl.[5] ..... A47G 91/00

[52] U.S. Cl. ..... 248/346.1; D7/624; 215/100.5

[58] Field of Search ..... 248/346.1; 215/100.5; D7/45; 47/71

[56] References Cited

U.S. PATENT DOCUMENTS

| | | | |
|---|---|---|---|
| 2,595,961 | 5/1952 | Layne | 248/346.1 |
| 2,601,312 | 6/1952 | McGrew | 248/346.1 |
| 2,652,703 | 9/1953 | Keegan | 248/346.1 |
| 2,680,931 | 6/1954 | Champion | 248/346.1 |
| 2,688,858 | 9/1954 | Cosmetto | 248/346.1 |
| 2,709,905 | 6/1955 | Dunlap | 248/346.1 |
| 2,893,163 | 7/1959 | Hazel, Jr. | 248/346.1 |
| 3,195,847 | 7/1965 | Squires | 248/346.1 |
| 3,257,092 | 6/1966 | Blundell | 248/346.1 |
| 3,268,198 | 8/1966 | Swett | 248/346.1 |
| 3,348,800 | 10/1967 | Wiechers | 248/346.1 |
| 3,797,796 | 3/1974 | Lansdowne | 248/346.1 |
| 3,808,084 | 4/1974 | Dory | 248/346.1 |
| 4,089,498 | 5/1978 | Woodruff | 248/346.1 |
| 4,137,356 | 1/1979 | Shoemaker et al. | 248/346.1 X |
| 4,206,570 | 6/1980 | Cooper | 215/100.5 X |
| 4,546,946 | 10/1985 | Jenison | 248/346.1 |
| 4,750,632 | 6/1988 | Pieper | 215/100.5 X |
| 4,759,524 | 7/1988 | Anderson | 248/346.1 |

*Primary Examiner*—Ramon O. Ramirez
*Attorney, Agent, or Firm*—Mark E. Ogram

[57] ABSTRACT

A coaster with the attributes of a wipe wherein two layers of absorbent material such as paper are separated by spacers. As the condensation collects on the upper absorbent layer, it sags and creates air pockets preventing the wet glass from sticking to the coaster. Through judicious choices in the spacers, the resulting coaster can be as flexible as a paper napkin or can be used for entertainment.

17 Claims, 2 Drawing Sheets

FIG. 1A
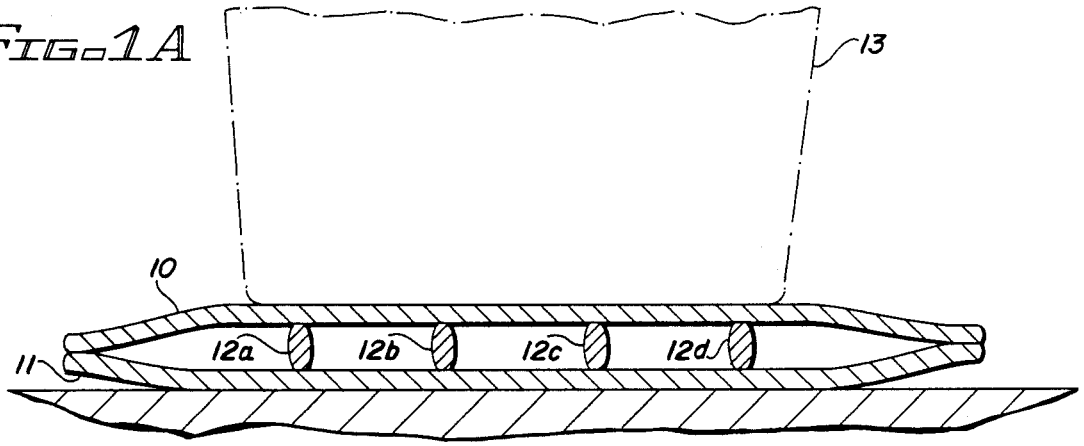
FIG. 1B
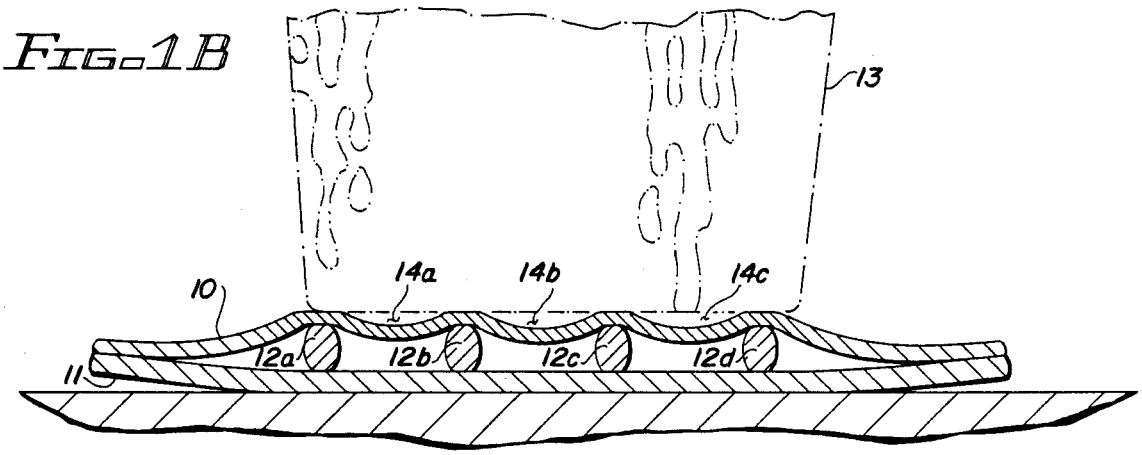
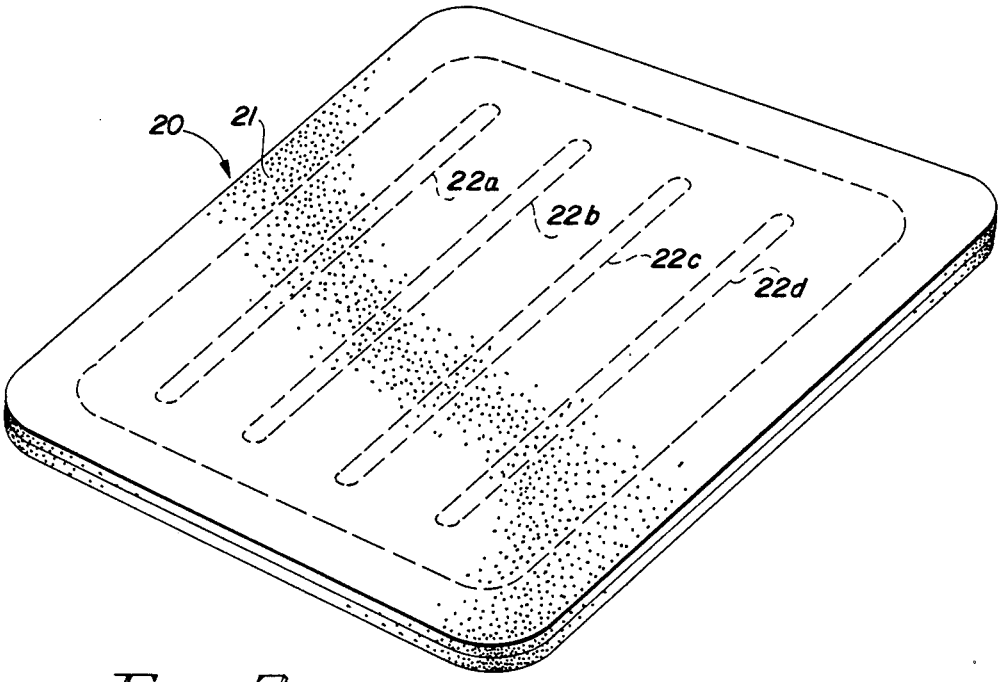
FIG. 2

COASTER AND WIPE

BACKGROUND

This invention relates generally to coasters for drinking glasses and the like and more particularly to an improved coaster/ wipe.

Coasters for wet drinking glasses have been around for decades if not centuries. Their purpose is to absorb the naturally occurring condensation from the side of the wet drinking glass so that the water does not mark or scar the table or bar beneath the drinking glass.

Although some coasters are made of cloth-like material, most commercial coasters are constructed of cardboard or some other stiff corrugated material. This creates a relatively inexpensive coaster for use in a bar or restaurant and permits the discarding of the coaster after its initial use.

Such coasters are described in: U.S. Pat. No. 3,348,800, entitled "Coaster and Method of Making the Same" issued Sept. 16, 1965, to Wiechers; and U.S. Pat. No. 2,709,905, entitled "Coaster" issued June 7, 1955, to Dunlap.

One of the main problems with the use of corrugated material or cardboard is that it is a poor absorbent. Condensed water from the drinking glass collects on the cardboard's slick surface. In a short period of time, this makes the coaster useless and only supplies a reservoir of water to drip onto the counter or the person using the glass.

Another solution to the problem which has been attempted is merely diverting the condensed water away from the drinking glass. Such devices are described in: U.S. Pat. No. 2,601,312, entitled "Coaster" issued Apr. 15, 1946, to McGrew; U.S. Pat. No. 2,595,961, entitled "Coaster" issued May 6, 1952, to Layne; U.S. Pat. No. 2,652,703, entitled "Coaster" issued Sept. 22, 1953, to Keegan; U.S. Pat. No. 2,680,931, entitled "Coaster" issued June 15, 1954, to Champion; U.S. Pat. No. 2,688,858, entitled "Goblet Coaster" issued Sept. 14, 1954, to Cosmetto; U.S. Pat. No. 2,893,163, entitled "Coaster" issued July 7, 1959, to Hazel Jr.; and U.S. Pat. No. 3,808,084, entitled "Executive Coaster" issued Apr. 30, 1974, to Doty.

In all of these situations, the coaster is severely limited by the size of the reservoir. Since the water must collect in free flowing liquid form, the reservoir permits spills from the coaster-container during clean-up or simple movement of the coaster.

Additionally, these devices are relatively expensive for such establishments as restaurants and bars which must utilize coasters that cost mere pennies.

To eliminate the problem of the free water in the coaster and the limited reservoir problem, one type of coaster provides for the insertion of an absorbent material beneath a grate so that the condensed water falls from the drinking glass onto the absorbent material. This effectively secures the condensed water.

This arrangement is described in: U.S. Pat. No. 3,257,092, entitled "Coaster" issued June 21, 1966, to Blundell; U.S. Pat. No. 3,268,198, entitled "Coaster" issued Aug. 23, 1966, to Sweet; and U.S. Pat. No. 4,089,498, entitled "12 Hour Coaster" issued May 16, 1978, to Woodruff.

Although these solutions do create a "less messy" coaster, they do nothing to eliminate the expense associated with the coaster. In fact, they cost more.

Expense is one of the concerns for a commercial establishment. Whereas the above coasters cost upwards to a dollar each, a restaurant or bar must have the cost down at less that five cents each.

Additionally, these coasters serve a single function, that of protecting the counter from condensed water. Because of their rigid nature, they are totally unsuitable to act as a wipe for either the counter or the customers.

In an effort to reduce the cost and inventory, many eating and drinking establishments have eliminated the specialized coaster and instead utilize paper napkins. This has the added advantage of reducing the inventory of material that is needed by the restaurant or bar. The napkin provides some protection for the counter and can also be used as a wipe by either the operator of the restaurant or as a wipe by the patron.

Paper napkins, although individually inexpensive, absorb the condensed water. Due to the pressure of the drinking glass, a bond is created between the soaked napkin and the bottom of the glass. Hence, when the customer raises the glass to drink, the napkin sticks to the bottom of the glass and invariably falls onto the lap of the customer. This merely transfers the condensed water from the napkin to the customer's clothing.

The "stuck" napkin also encourages the customer to discard it and take another dry napkin. Hence, the cost is doubled, tripled, and even quadrupled as the customer uses more and more convention paper napkins.

It is clear from the forgoing that an inexpensive, nonspecialized, and effective coaster does not exist.

SUMMARY OF THE INVENTION

This invention utilizes an inexpensive flexible absorbent material such as paper. The invention provides within the coaster, spacers which act as supports for the glass. A layer of flexible absorbent material covers these supports.

As condensation occurs, the water from the surface of the wet drinking glass is absorbed by the paper. As the paper collects more water, it "sags" between the spacers creating air pockets leaving the spacers to support the drinking glass. Due to the existence of air pockets, the coaster is unable to "stick" to the wet drinking glass and remains on the counter or bar top when the drinking glass is removed.

Although the above description refers to the use of paper, those of ordinary skill in the art readily recognize that any flexible absorbent material could be used in this context.

The key to this invention is the use of the heretofore wasted condensed water to solve its own problem by absorbing onto the material, creating more weight to the absorbent material and causing the absorbent material to "sag", and thereby creating air pockets between the drinking glass and the coaster.

Without the use of the spacers to support the drinking glass, the invention cannot operate. It is the supports that permit the absorbent material to sag away from the glass.

These spacers can be made of anything that will support the weight of the drinking glass. Such materials as thin cardboard strips, plastic rods, plastic beads, and others are obvious to those of ordinary skill in the art.

The shape and dimensions of the spacers is of little consequence so long as it provides solid support for the drinking glass.

In the preferred embodiment, the spacers are rod shaped and are positioned parallel to each other. In one embodiment of the invention, these rod-shaped spacers are inserted into a multi-layer absorbent material. The rod-shaped spacers create a ridge arrangement to support the wet drinking glass.

Other possible arrangements for the spacers include cylindrical shaped beads which are spread between two layers of the paper absorbent, and even very short rods which are either "haphazardly" arranged or uniformly arranged between the absorbent material.

One artistic embodiment of the present invention creates a plastic spacer in the shape of a famous person's profile, a landmark, or the such. Although the profile is not visible on the dry coaster/wipe, when wet, the overlying paper sags and reveals the outline. This provides entertainment for the bar customer.

Another important attribute to the present invention is that the spacers do not create a totally rigid coaster. The coaster has a degree of flexibility and therefore can be used as a napkin or wipe for the counter/ bar.

The invention, together with its various attributes will be more clearly described by the following drawings and their accompanying descriptions.

DRAWINGS IN BRIEF

FIGS. 1*a* and 1*b* are cross sectional views of an embodiment of the invention illustrating the air gap concept of the invention.

FIG. 2 is a pictorial representation of an embodiment of the invention.

DRAWINGS IN DETAIL

Figure 3:
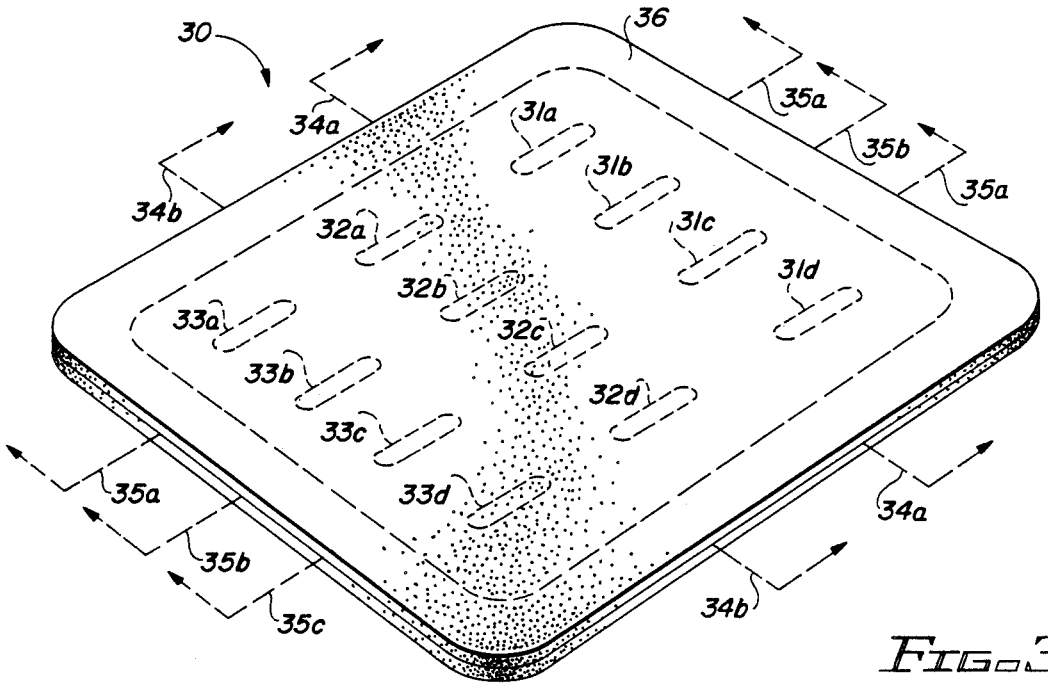
FIG. 3 is a pictorial representation of another embodiment of the invention.

Referring to FIGS. 1*a*, glass 13 is supported by spacers 12*a*, 12*b*, 12*c*, and 12*d*. In this embodiment, spacers 12*a*, 12*b*, 12*c*, and 12*d* are linear rods and are positioned parallel to each other.

Surrounding spacers 12*a*, 12*b*, 12*c*, and 12*d* are paper layer 10 and paper layer 11. This arrangement provides an envelope created by the paper layers 10 and 11 and is maintained by spacers 12*a*, 12*b*, 12*c*, and 12*d*.

FIG. 1*b* illustrates the action that takes place as paper layer 10 collects the condensation from glass 13. The weight of the collected condensed water causes the paper to sag between spacers 12*a* and 12*b*, 12*b* and 12*c*, 12*c* and 12*d*. This sagging causes air pockets 14*a*, 14*b*, and 14*c* to be created.

Air pockets 14*a*, 14*b*, and 14*c* prevent sufficient "suction" or bonding to take place between glass 13 and paper layer 10 for the lifting of glass 13 to move the coaster.

FIG. 2 illustrates an embodiment of the invention as first described in FIG. 1. The coaster 20 of FIG. 2 is substantially rectangular in shape; those of ordinary skill in the art readily recognize alternative shapes such as ovals, circles, etc.

The two paper layers are bonded around the periphery 21 creating an envelope therebetween. Interposed in this envelope are spacers 22*a*, 22*b*, 22*c*, and 22*d*. Each of these spacers are rod shaped and are substantially parallel to each other and extend substantially the width of coaster 20.

Flexibility of this coaster, although greater than the existing art, is limited. Coaster 20 can be folded only parallel to spacers 22*a*, 22*b*, 22*c*, and 22*d*.

Another embodiment is illustrated in FIG. 3. In this embodiment, again the periphery 36 of the two paper layers are bonded to each other creating an envelope therebetween.

In this embodiment, the spacers are shorten rods which are positioned in rows and columns. Hence, spacers 31*a*, 31*b*, 31*c*, and 31*d* are all parallel to each other and form a single row. Similar arrangements are made with spacers 32*a*, 32*b*, 32*c*, and 32*d* as well as spacers 33*a*, 33*b*, 33*c*, and 33*d*.

Because of this arrangement, utilizing short rods in row and column arrangement, the resulting coaster/ wipe is more flexible and can be bent not only along the columns as illustrated by arrows 35*a*, 35*b*, and 35*c*, but also along the rows as illustrated by arrows 34*a* and 34*b*.

This arrangement creates a more flexible wipe than that illustrated in FIG. 2 and is more acceptable as a "napkin substitute".

Figure 4:
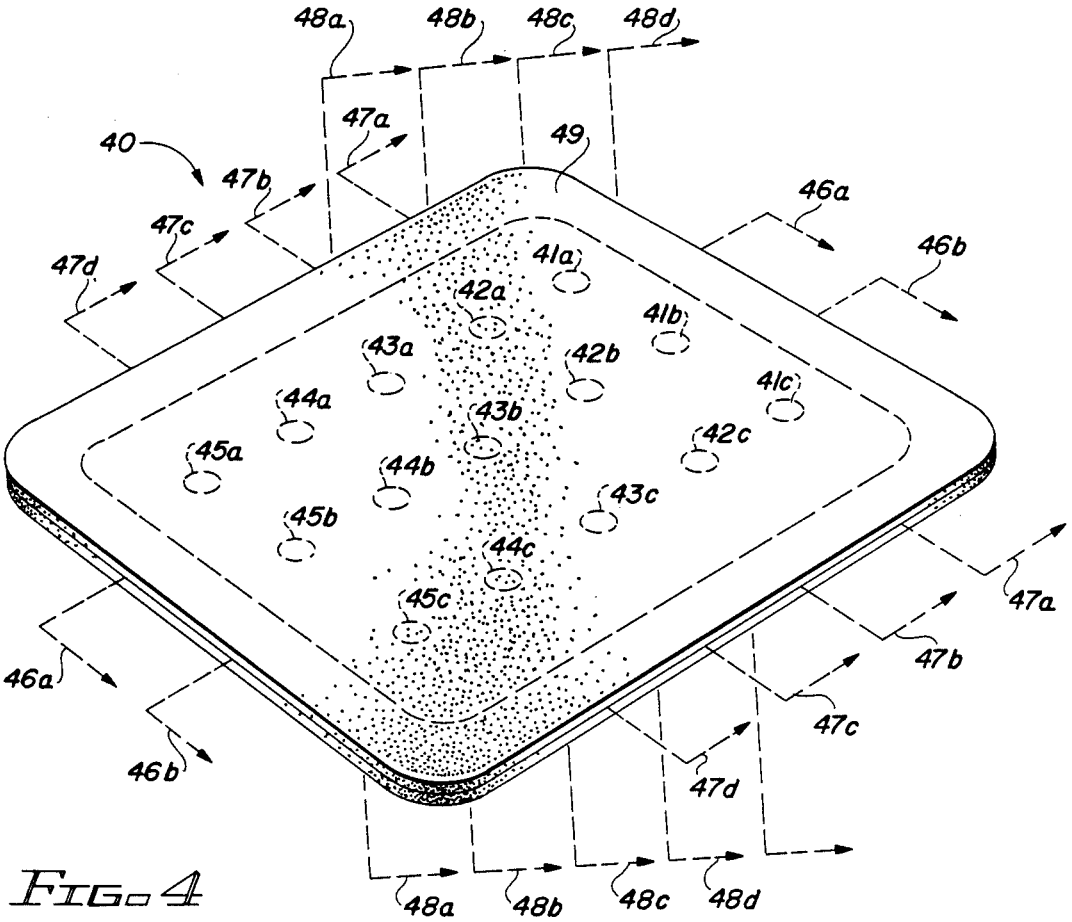
FIG. 4 is a pictorial representation of still another embodiment of the invention.

An even more versatile arrangement is shown by the embodiment illustrated in FIG. 4. Again, coaster/ wipe 40 has the periphery 49 of the two paper layers bonded to each other creating the envelope containing the spacers 41*a*, 41*b*, 41*c*, 42*a*, 42*b*, 42*c*, 43*a*, 43*b*, 43*c*, 44*a*, 44*b*, 44*c*, 45*a*, 45*b*, and 45*c*. These spacers, such as spacer 41*a*, are cylindrical in shape and are arranged in rows and columns.

The distance between the spacers is chosen so as to provide proper support for the drinking glass.

This arrangement and shape of the spacers (cylindrical) permit the coaster/wipe to be even more flexible and dual-purpose (coaster and napkin wipe) since not only can the coaster/wipe bend along the columns as illustrated by arrows 46*a* and 46*b*, and along the rows as illustrated by arrows 47*a*, 47*b*, 47*c*, and 47*d*, but also on the diagonal as illustrated by arrows 48*a*, 48*b*, 48*c*, and 48*d*.

To the user of the embodiment illustrated in FIG. 4, the coaster "feels" and "performs" substantially as a napkin but has the desirable attributes of non-sticking found in a coaster.

The bartender or waiter need only have one type of product. This eliminates a variety of inventory; and since the components of the invention, paper, corrugated strips, and/or plastic, are inexpensive, the coaster/wipe is well within the price constraints of a commercial establishment.

Although the figures utilize certain shapes and materials, those of ordinary skill in the art readily recognize alternatives which will perform the objectives of the present invention.

What is claimed is:

1. A coaster/wipe comprising:

(a) a first layer of flexible absorbent material of a preselected first size;

(b) a second layer of flexible absorbent material having a size substantially the same as the preselected first size, said second layer of flexible absorbent material being bound to the first layer of flexible absorbent material around its periphery thereof; and, (c) at least two semi-rigid spacers positioned between said first layer of flexible absorbent material and the second layer of flexible absorbent material.

2. The coaster/wipe according to claim 1 wherein said first layer of flexible absorbent material and said second layer of flexible absorbent material include sheets of paper.

3. The coaster/wipe according to claim 2 wherein said at least two spacers are attached to said first layer of flexible absorbent material.

4. The coaster/wipe according to claim 3 wherein said at least two spacers are rod shaped, and wherein each of said spacers extends substantially the length of said first layer of flexible absorbent material.

5. The coaster/wipe according to claim 4 wherein said at least two spacers are placed parallel to each other.

6. The coaster/wipe according to claim 3 wherein said at least two spacers include a first set of spacers and a second set of spacers, and wherein each of the first set of spacers is positioned parallel to each other, each of the second set of spacers is positioned in a linear relationship with at least one spacer of said first set of spacers.

7. The coaster/wipe according to claim 3 wherein said at least two spacers are substantially cylindrical in shape.

8. An improved coaster/wipe comprising:

(a) a first layer of paper;

(b) at least two spacers attached to the first layer of paper; and, (c) a second layer of paper attached to the periphery of said first layer of paper encapsulating the spacers between them.

9. The improved coaster/wipe according to claim 8 wherein said at least two spacers are rod shaped, and wherein each of said spacers extends substantially the length of said first layer of flexible absorbent paper.

10. The improved coaster/wipe according to claim 9 wherein said at least two spacers are placed parallel to each other.

11. The improved coaster/wipe according to claim 8 wherein said at least two spacers include a first set of spacers and a second set of spacers, and wherein each of the first set of spacers is positioned parallel to each other, each of the second set of spacers is positioned in a linear relationship with at least one spacer of said first set of spacers.

12. The improved coaster/wipe according to claim 8 wherein said at least two spacers are substantially cylindrical in shape.

13. A multiple use wipe comprising:

(a) a single sheet of flexible absorbent material having at least two layers therein attached to their peripheries; and, (b) at least two longitudinal spacers inserted between the layers of said single sheet of flexible absorbent material.

14. The multiple use wipe according to claim 13 wherein said longitudinal spacers are positioned substantial parallel to each other.

15. An entertainment coaster comprising:

(a) a first layer of flexible absorbent material of a preselected first size;

(b) a second layer of flexible absorbent material having a size substantially the same as the preselected first size, said second layer of flexible absorbent material being bound to the first layer of flexible absorbent material around its periphery thereof; and, (c) a pictorially stylized spacer positioned between said first layer of flexible absorbent material and the second layer of flexible absorbent material.

16. The entertainment coaster according to claim 15 wherein said first layer of flexible absorbent material and said second layer of flexible absorbent material include sheets of paper.

17. The entertainment coaster according to claim 16 wherein said pictorially stylized spacer is attached to said first layer of flexible absorbent material.

* * * * *